United States Patent [19]

Cline et al.

[11] Patent Number: 4,512,665

[45] Date of Patent: Apr. 23, 1985

[54] ADJUSTABLE OVER-THE-TOP AGITATOR FOR A LIQUID MANURE TANK

[75] Inventors: Kevin W. Cline, Arlington Heights; Stephen L. Kretschmer, Elk Grove, both of Ill.

[73] Assignee: A. O. Smith Harvestore Products, Inc., Arlington Heights, Ill.

[21] Appl. No.: 523,131

[22] Filed: Aug. 15, 1983

[51] Int. Cl.[3] ..... B01F 15/02

[52] U.S. Cl. ..... 366/167; 366/173; 285/282

[58] Field of Search ..... 137/563; 285/168, 184, 285/276, 282, DIG. 8; 366/136, 137, 159, 163, 164, 167, 190, 191, 270

[56] References Cited

U.S. PATENT DOCUMENTS

| | | | |
|---|---|---|---|
| 2,739,779 | 3/1956 | Krone | 285/184 |
| 3,622,132 | 11/1971 | Rawlings | 285/276 |
| 3,871,272 | 3/1975 | Melandri | 366/137 |
| 4,207,920 | 6/1980 | Westerhoff | 285/168 |
| 4,332,484 | 6/1982 | Peters | 366/159 |

FOREIGN PATENT DOCUMENTS

| | | | |
|---|---|---|---|
| 0083618 | 11/1895 | Fed. Rep. of Germany | 285/282 |

*Primary Examiner*—Robert W. Jenkins
*Assistant Examiner*—Arthur D. Dahlberg
*Attorney, Agent, or Firm*—Andrus, Sceales, Starke & Sawall

[57] ABSTRACT

An adjustable over-the-top agitator for a liquid manure tank. To periodically break up the crust on liquid manure stored in an open top tank, the liquid manure is withdrawn from the bottom of the tank and is discharged through a nozzle on the end of an external delivery pipe into contact with the crust. The upper end of the delivery pipe is connected by a swivel coupling to a vertical end of a connecting pipe, while the opposite horizontal end of the connecting pipe is connected by a second swivel coupling to the discharge nozzle. By rotating the connecting pipe about the axis of the delivery pipe, the nozzle can be moved in a horizontal path, while swiveling the discharge nozzle about the horizontal end of the connecting pipe moves the nozzle in a vertical arc. A torsion spring is associated with the second swivel coupling to bias the discharge nozzle to a horizontal position. Through use of the horizontal and vertical adjustments, the nozzle can be directed to all locations in the tank to more effectively break up the crust on the top of the liquid manure mass.

7 Claims, 7 Drawing Figures

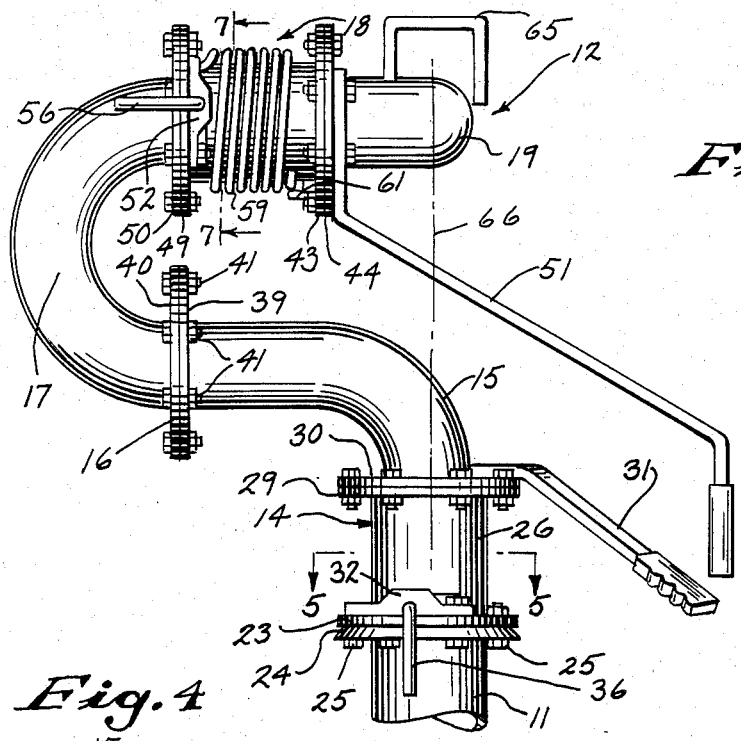
Fig. 3
Fig. 4
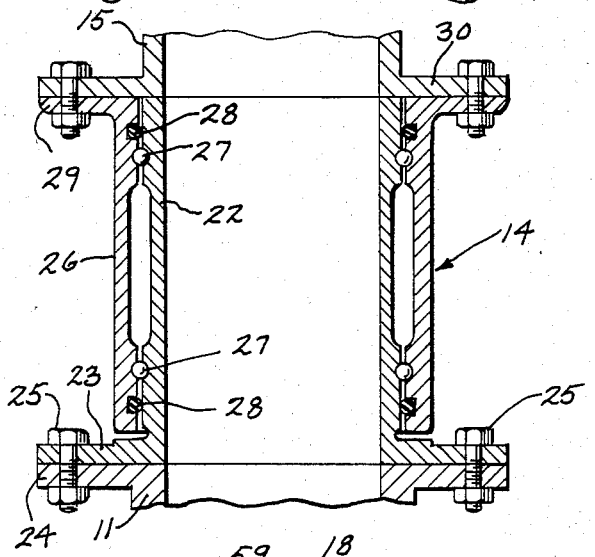
Fig. 5
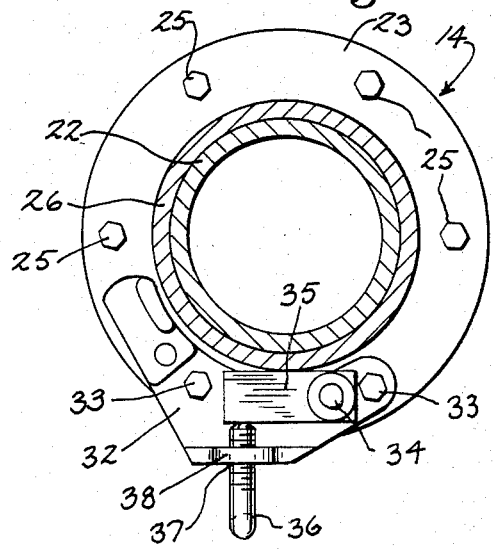
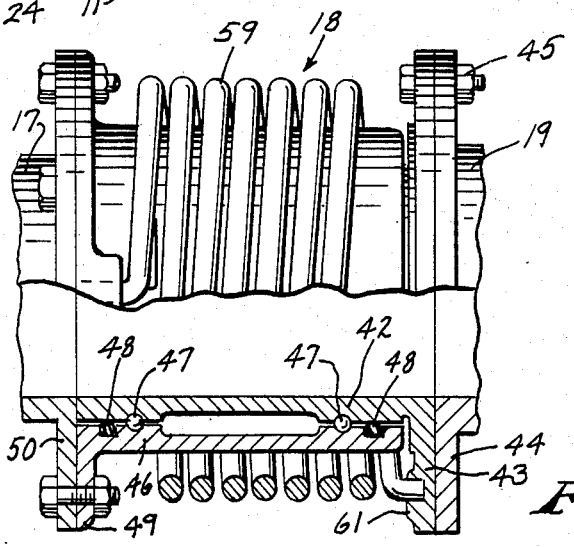
Fig. 6
Fig. 7
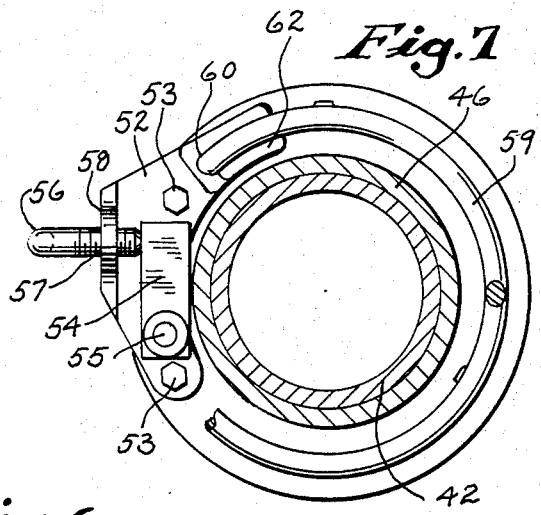

ADJUSTABLE OVER-THE-TOP AGITATOR FOR A LIQUID MANURE TANK

BACKGROUND OF THE INVENTION

In a liquid manure storage system, the manure is initially delivered to a pit in the barn or other livestock area. The manure is then diluted with water and homogenized in the pit, and then pumped through an underground line to a large open top manure storage tank. The liquid manure is stored for long periods of several months or more in the storage tank, and during storage the lighter-than-liquid fibrous material, such as straw and hay derived from animal bedding, will stratify as an upper layer above the liquid and heavier-than-liquid solids. Over a period of time, the lighter, fibrous materials, form a thick crust on the top of the tank and depending upon the amount of fibrous material and the time of accumulation, the crust can be several feet thick.

When it is desired to withdraw the liquid manure from the storage tank, it is necessary to break up the crust and homogenize the mass, so that it can be pumped into a mobile tank for spreading on the fields.

U.S. Pat. No. 4,332,484 describes an agitation system for a liquid manure tank which is utilized to agitate and homogenize the liquid slurry, so that it can be pumped from the tank. In accordance with the agitation system of the aforementioned patent, the liquid manure is withdrawn from the bottom of the tank through a supply line by a pump which is located on the exterior of the tank. The discharge of the pump, through valving, can either deliver the liquid manure through a conduit embedded in the tank foundation to a center rotatable agitator, or alternately, deliver the liquid manure to a vertical delivery pipe which extends upwardly along the wall of the tank where the slurry can then be discharged through a nozzle into the open end of the tank to break up the crust. As a third route of delivery, the liquid manure, after homogenizing, can be delivered by the pump to a discharge pipe for discharge to a mobile manure spreader.

In order to properly break up the thick crust on the top of the tank, it is necessary to periodically change the direction of discharge of the over-the-top nozzle. For example, in breaking up the crust, it may be necessary to direct the liquid manure to a given area in the crust for several hours to develop a hole in the crust and then move the delivery to other areas to similarly provide holes in the crust which will ultimately join together to form small crust islands. At times during the operation, it is also necessary to discharge the manure slurry tangentially around the tank to provide a swirling action and break the crust loose from the wall of the tank.

With the system described in U.S. Pat. No. 4,332,484, the over-the-top nozzle could be adjusted in a horizontal plane by loosening the coupling of the pump outlet to the vertical delivery pipe and then rotating the delivery pipe and discharge nozzle. Loosening the coupling during operation of the system often resulted in substantial leakage until the coupling was retightened, and as the adjustment was carried out at ground level, the operator could not accurately determine the position of penetration of the liquid slurry into the crust.

SUMMARY OF THE INVENTION

The invention is directed to an improved adjusting mechanism for an over-the-top agitator for a liquid manure storage tank in which the discharge nozzle is provided with universal movement to more effectively break up the crust on the top of the manure mass.

In accordance with the invention, the upper end of the delivery pipe, which extends along the exterior of the tank, is connected by a swivel coupling to the vertical end of a connecting pipe assembly and the horizontal end of the assembly is connected by a second swivel coupling to a generally L-shaped discharge nozzle. A torsion spring is associated with the second swivel coupling and serves to bias the discharge nozzle to a generally horizontal position.

Mounted at the top of the tank, adjacent the upper end of the delivery pipe, is an operator's platform and operating handles are connected to both swivel couplings. The operator, by rotating the connecting pipe relative to the upper end of the delivery pipe can move the discharge nozzle in a generally horizontal path, while swiveling the discharge nozzle relative to the horizontal end of the connecting pipe can also move the nozzle in a generally vertical path of movement. A locking mechanism is associated with each swivel coupling to lock the pipes in the desired attitude after the adjustment is made.

Through use of the horizontal and vertical adjustments, discharge of liquid manure can be directed to all locations in the tank to provide a more effective operation in breaking up the crust. The vertical adjustment provides greater reach for the stream of manure and enables the over-the-top agitator to be used with larger diameter tanks. The horizontal adjustment enables the nozzle to sweep horizontally across the tank, as well as to direct the stream of liquid manure tangentially within the tank to provide a swirling motion for better homogenization of the materials.

Other objects and advantages will appear in the course of the following description.

DESCRIPTION OF THE DRAWINGS

The drawings illustrate the best mode presently contemplated of carrying out the invention.

In the drawings:

FIG. 3 is a view taken along line 3—3 of FIG. 2;

FIG. 4 is a longitudinal section of the swivel joint connecting the upper end of the delivery pipe to the connecting pipe;

FIG. 5 is a section taken along line 5—5 of FIG. 3;

FIG. 6 is a longitudinal section showing the construction of the swivel joint for connecting the horizontal end of the connecting pipe to the discharge nozzle; and FIG. 7 is a section taken along line 7—7 of FIG. 3.

DESCRIPTION OF THE ILLUSTRATED EMBODIMENT

Figure 1:
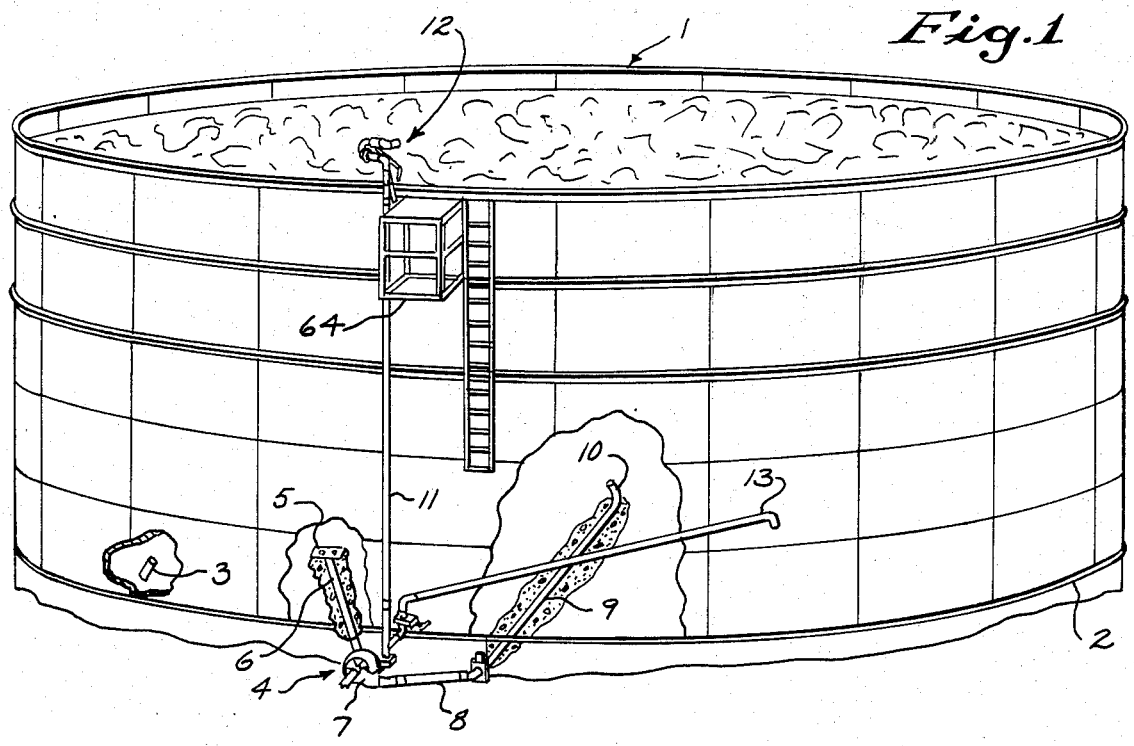
FIG. 1 is a perspective view of a liquid manure tank incorporating the adjustable over-the-top agitator of the invention.

FIG. 1 shows an open top tank 1, which can be formed of a series of generally curved, glass coated panels, and is adapted to contain a liquid manure slurry. Tank 1 is mounted on a concrete foundation 2.

The liquid manure is supplied to tank 1 through an inlet pipe 3, which is normally connected to a manure pit in the barn, and extends underground and is embedded within the foundation 2. A pump located in the manure pit will deliver the liquid manure through pipe 3 to the lower portion of tank 1 for storage.

In order to periodically agitate and homogenize the liquid manure slurry, an agitation system 4 similar to that shown in U.S. Pat. No. 4,332,484, can be utilized. In accordance with the agitation system, the liquid manure slurry is withdrawn from the lower end of tha tank through an outlet 5 formed in foundation 2 and is conducted through a pipe 6, which is embedded within the foundation, to the suction side of pump 7, mounted on the exterior of tank 1. The discharge from pump 7 is connected to a pipe 8 which, in turn, is connected to a pipe 9 that is embedded within foundation 2 and terminates in an adjustable center agitator nozzle 10, located generally at the center of foundation 2. Thus, the liquid manure being withdrawn from the tank through the pipe 6 can be discharged by the pump through the rotating center nozzle 10 to provide agitation and homogenization of the settled manure mass.

During the agitation cycle, the liquid manure being discharged by pump 7 is also routed by suitable valving through a vertical delivery pipe 11, where it is discharged through an over-the-top nozzle assembly 12, onto the top of the manure mass to break up the crust. After thoroughly homogenizing the liquid mass in tank 1, the discharge from the pump 7 can be directed by suitable valving through a discharge pipe 13 for delivery to a mobile liquid manure tank for application to the fields.

The over-the-top nozzle assembly 12 includes a swivel coupling 14 which connects the upper end of delivery pipe 11 with the lower or vertical end of elbow 15. The opposite end of elbow 15 is connected by coupling 16 to one end of a U-shaped pipe 17 and the opposite end of pipe 17 is connected through a second swivel coupling 18 to a generally L-shaped nozzle pipe 19, having a discharge outlet 20. As best illustrated in FIG. 3, a vertical plane passing longitudinally through nozzle 19 lies along the vertical axis of the delivery pipe 11.

As illustrated in FIGS. 4 and 5, the swivel coupling 14 includes an inner sleeve 22 having a flange 23 that is joined to a mating flange 24 on delivery pipe 11 by a series of bolts 25. A sealing compound can be used to seal the joint between the mating flanges 23 and 24. Swivel coupling 14 also includes an outer sleeve 26 which is journaled on inner sleeve 22 by two races of ball bearings 27. The joint between the inner sleeve and outer sleeve 26 is sealed by a pair of O-rings 28. As best shown in FIG. 4, the end of the outer sleeve 26 is provided with an outwardly extending flange 29 which is joined to a flange 30, on elbow 15 by a series of bolts.

As illustrated in FIG. 3 , a handle is connected to flange 30, and through movement of handle 31, the elbow 15, as well as pipe 17, swivel coupling 18, and nozzle pipe 19, can be rotated or swiveled horizontally.

To lock the swivel coupling in a given position a block 32 is connected to flange 23 by bolts 33, and as shown in FIG. 5, the block is curved in shape and extends through an arc of approximately 90°. Pivoted to the central portion of block 32 by pivot pin 34 is a generally rectangular shoe 35. Shoe 35 is adapted to be moved inwardly into engagement with outer sleeve 26 by a threaded handle 36, which is threaded within hole 37 formed in the upstanding flange 38 on block 32. By threading the handle 36 inwardly, the inner end of the handle will engage the shoe 35 to pivot the shoe inwardly against the outer surface of sleeve 26 to lock the sleeve against the inner sleeve 22 and prevent relative rotation between the sleeves.

To pivot the nozzle pipe 19 in a horizontal path, the threaded handle 36 is loosened, and the elbow 15, pipe 17, coupling 18 and nozzle pipe 19 can then be pivoted in a horizontal plane through operation of the handle 31.

Coupling 16 includes a pair of mating flanges 39 and 40 which are welded to the pipes 15 and 17 respectively. Flanges 39 and 40 are joined together by bolts 41 and a suitable sealing material can be located between the mating flanges to seal the same.

The second swivel coupling 18 is similar in construction to swivel coupling 14 and includes an inner sleeve 42 having a flange 43, which is joined to flange 44 on the horizontal end of pipe 19 by bolts 45. Swivel coupling 18 also comprises an outer sleeve 46 which is journaled about inner sleeve 42 by a pair of ball bearing races 47 and the joint between the two sleeves is sealed by a pair of O-rings 48.

The end of outer sleeve 46 is formed with a flange 49 which is joined to a flange 50 on pipe 17 by a series of bolts. In addition, a sealing compound can be interposed between the mating flanges.

As illustrated in FIG. 3, an operating handle 51 is connected to the flange 44 and through operation of the handle the discharge nozzle 19 can be moved in a vertical plane.

The swivel coupling 18 can be locked in any given position by a locking mechanism similar to that described with respect to swivel coupling 14. In this regard, a block 52 is secured to the flange 49 on outer sleeve 46 by a series of bolts 53. Block 52 is similar in configuration to block 32. A shoe 54 is pivotally connected to the outer surface of block 52 by pin 55 and threaded handle 56, similar to handle 36, is threaded within a hole 57 in flange 58 of block 52 and the inner end of the threaded handle 56 is adapted to engage shoe 54. As previously described, threading down of the handle 56 will pivot the shoe 54 inwardly against the outer sleeve 46 to lock the outer sleeve relative to the inner sleeve and maintain the nozzle in a given vertical position.

A torsion spring 59 is incorporated to bias or counterbalance the discharge nozzle to a generally horizontal attitude when locking handle 56 is released. As best shown in FIGS. 3 and 6, torsion spring 59 is disposed around outer sleeve 46 and one end of the torsion spring is received within hole 60 in block 52, while the opposite end of the torsion spring is engaged within a boss 61 formed on flange 43 on inner sleeve 42. A boss or upstanding ridge 62 is provided on the block to maintain the torsion spring in spaced relation to the outer sleeve. With this construction, the force of the spring will urge the discharge nozzle to a generally horizontal position.

The inner surface of nozzle 19 is provided with a plurality of straight vanes 63 which aid in maintaining the integrity of the stream and prevents the stream from diverging.

When it is desired to agitate the crust and homogenize the liquid manure mass, the valving for pump 7 is arranged so that the liquid manure is discharged from the pump through the delivery pipe 11. The operator, standing on platform 64 located adjacent the top of the tank next to the nozzle assembly 12, can then through the vertical and horizontal adjustments direct the delivery of the liquid slurry from nozzle 19 to any desired location. For example, by loosening the swivel coupling 14 by unthreading the lock handle 36, the nozzle 19 can be swung horizontally to direct the discharge to any desired location. The operator can then lock the nozzle in this horizontal position. Similarly, by loosening the locking handle 56, the operator, through use of the handle 51, can pivot the nozzle in a vertical plane to adjust the reach of the stream. The nozzle can then be locked in this vertical attitude by threading down of the locking handle 56.

When the nozzle pipe 19 is pivoted to is extreme downward position along the wall of tank 1, the operating handle 51 will extend outwardly at a location which may not be fully accessible to the operator. Consequently, a handle 65 is attached to nozzle pipe 19 and the operator, if desired, can use handle 65 to adjust the position of nozzle pipe 19.

Figure 2:
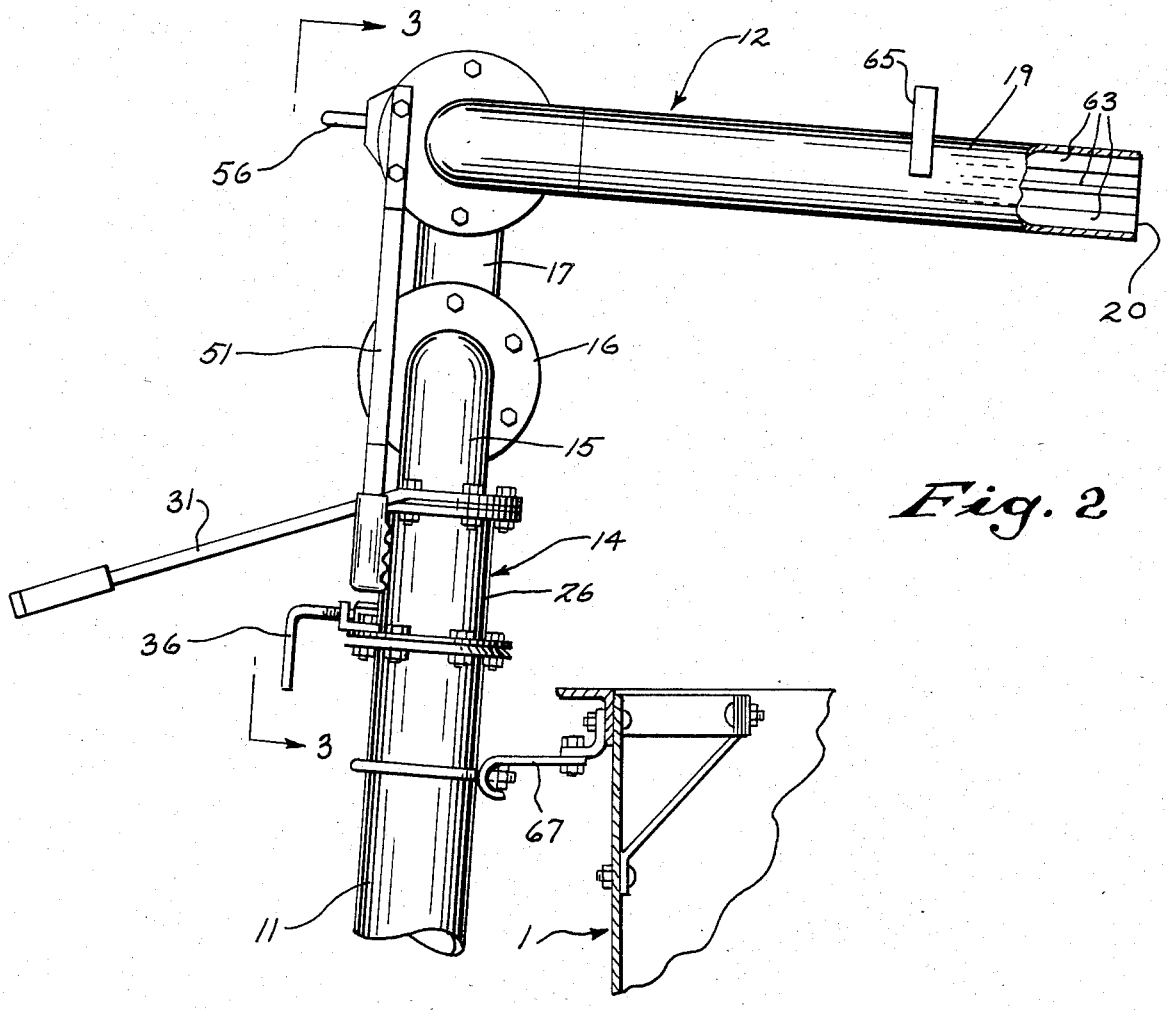
FIG. 2 is a side elevation of the storage tank and showing the adjustable agitator.

Through use of the elbow 15 and U-shaped pipe 17, a vertical plane 66, as shown in FIG. 3, extending longitudinally through nozzle 19 will lie along the axis of the delivery pipe 11. With this configuration, the thrust of the nozzle is resisted by standoff bracket assembly 67 in FIG. 2, and is in vertical alignment with the delivery pipe 11, thereby preventing pinwheeling of the discharge nozzle when unlocked and possible injury to the operator.

The over-the-top agitator of the invention improves the efficiency of crust agitation and enables a given depth of crust to be broken up in a shorter period. Moreover, the agitator is capable of removing thick and tenacious crust that could not be satisfactorily removed by prior devices.

Various modes of carrying out the invention are contemplated as being within the scope of the following claims particularly pointing out and distinctly claiming the subject matter which is regarded as the invention.

We claim:

1. A manure agitation system, comprising an open top tank to contain liquid manure slurry and having an upper end, a generally vertical delivery pipe mounted on the exterior of the tank for conducting liquid manure upwardly to the top of the tank, a connecting conduit having a generally vertical end and a generally horizontal end, said horizontal end being disposed above the upper end of said tank, first swivel means for connecting said vertical end of said connecting conduit to the upper end of said delivery pipe, first locking means for locking said first swiveling means to prevent rotational movement between said connecting conduit and said delivery pipe, a generally L-shaped discharge nozzle disposed above the upper end of the tank, second swivel means connecting the horizontal end of said connecting conduit to one end of said discharge nozzle, the opposite end of said discharge nozzle being swingable in a vertical plane about said second swivel means, second locking means for locking said second swivel means and preventing relative rotational movement between the horizontal end of said connecting conduit and said discharge nozzle, and biasing means associated with said second swivel means for biasing said opposite end of said discharge nozzle to a generally horizontal position, said first and second swivel means providing generally universal adjustment for the position of said discharge nozzle to thereby enable the stream of liquid manure being discharged from said nozzle to be selectively distributed to any desired location in said tank.

2. The system of claim 1, wherein the axis of the delivery pipe lies in a vertical plane passing longitudinally through said opposite end of said nozzle.

3. The system of claim 1, wherein said connecting conduit includes a generally U-shaped section interconnecting said vertical end and said horizontal end.

4. The system of claim 1, and including a handle connected to each of said first and second swivel means to move said nozzle to the desired position for discharge of said liquid manure.

5. A manure agitation system, comprising an open top tank to contain liquid manure slurry and having an upper end, a delivery pipe mounted on the exterior of the tank for conducting liquid manure upwardly to the top of the tank, a connecting conduit having a generally vertical end and a generally horizontal end, said horizontal end being disposed above the upper end of said tank, first swivel means for connecting said vertical end of said connecting conduit to the upper end of said delivery pipe, a generally L-shaped discharge nozzle disposed above the upper end of the tank, and second swivel means connecting the horizontal end of said connecting conduit to one end of said discharge nozzle, the opposite end of said discharge nozzle being swingable in a generally vertical plane about said second swivel means, said first and second swivel means providing generally universal adjustment of the positon of said discharge nozzle to thereby enable the stream of liquid manure being discharged from said nozzle to be selectively distributed to all locations in said tank.

6. The system of claim 5, wherein said connecting conduit includes a generally U-shaped section interconnecting said vertical end and said horizontal end, the axis of said delivery pipe lying in a vertical plane passing longitudinally through said opposite end of said discharge nozzle.

7. The system of claim 6, and including a handle connected to each of said first and second swivel means to move said discharge nozzle to the desired position for discharge of said liquid manure, said handles being in proximate relation and being simultaneously accessible to an operator.

* * * * *